US006784421B2

(12) United States Patent
Park

(10) Patent No.: US 6,784,421 B2
(45) Date of Patent: Aug. 31, 2004

(54) METHOD AND APPARATUS FOR FOURIER TRANSFORM MASS SPECTROMETRY (FTMS) IN A LINEAR MULTIPOLE ION TRAP

(75) Inventor: Melvin A. Park, Billerica, MA (US)

(73) Assignee: Bruker Daltonics, Inc., Billerica, MA (US)

( * ) Notice: Subject to any disclaimer, the term of this patent is extended or adjusted under 35 U.S.C. 154(b) by 50 days.

(21) Appl. No.: 09/881,576

(22) Filed: Jun. 14, 2001

(65) Prior Publication Data

US 2002/0190205 A1 Dec. 19, 2002

(51) Int. Cl.[7] ..... H01J 49/36; H01J 49/42; H01J 49/00

(52) U.S. Cl. ..... 250/281; 250/282; 250/290; 250/291; 250/292

(58) Field of Search ..... 250/281, 292, 250/282, 290, 291

(56) References Cited

U.S. PATENT DOCUMENTS 4,924,089 A 5/1990 Caravatti

OTHER PUBLICATIONS

J.A. Castro et al., "Matrix–assisted Laser Desorption/Ionization of High–mass Molecules by Fourier–transform Mass Spectrometry", Rapid Commun. Mass Spectrom., 6, 239(1992).

M.B. Comisarow, "Fourier Transform Ion Cyclotron Resonance Spectroscopy", Adv. Mass Spectrom. 8, 1698(1980).

M.B. Comisarow, "Cubic Trapped–Ion Cell For Ion Cyclotron Resonance", Int. J. Mass Spectrom. Ion Phys. 37,251(1981).

A.G. Marshall et al., "Fourier Transform Ion Cyclotron Resonance Mass Spectrometry: A Primer." Mass Spectrom. Rev., 17, 1(1998).

R.C. Beavis and B.T. Chait, "Velocity Distributions of Intact High Mass Polypeptide Molecule Ions Produced by Matrix Assisted Laser Desorption", Chem. Phy. Lett. 181(5), 479(1991).

T.–W.D. Chan et al., "Initial Velocities of Positive and Negative Protein Molecule–Ions Produced in Matrix–Assisted Ultraviolet Laser Desorption Using a Liquid Matrix", Chem. Phy. Lett. 222,579(1994).

C. Koester et al., "High–Resolution Matrix–Assisted Laser Desorption/Ionization of Biomolecules by Fourier Transform Mass Spectrometry", J. Am. Chem. Soc. 114, 7572(1992).

J. Yao et al., "Analysis of High–Mass Biomolecules Using Electrostatic Fields and Matrix–Assisted Laser Desorption/Ionization in a Fourier Transform Mass Spectrometer", Anal. Chem. 67, 3638(1995).

T. Solouki and D.H. Russell, "Laser Desorption Studies of High Mass Biomolecules in Fourier–Transform Ion Cyclotron Resonance Mass Spectrometry", Proc. Natl. Acad. Sci. USA 89, 5701(1992).

(List continued on next page.)

*Primary Examiner*—Huan Tran
(74) *Attorney, Agent, or Firm*—Ward & Olivo

(57) ABSTRACT

An apparatus and method whereby ions from an ion source can be selected and transferred via a multipole analyzer by inductive detection. Ions generated at an elevated pressure are transferred by a pump and capillary system into a multipole device. The multipole device is composed of one analyzing section with two trapping sections at both sides. When the proper voltages are applied, the trapping sections trap ions within the analyzing region. The ions are then detected by two sets of detection electrodes.

24 Claims, 5 Drawing Sheets

OTHER PUBLICATIONS

T. Solouki et al., "Detection of High–Mass Biomolecules in Fourier Transform Ion Cyclotron Resonance Mass Spectrometry: Theoretical and Experimental Investigations", Anal. Chem. 66, 1583(1994).

V.H. Vartanian et al., "Open Cell Analog of the Screened Trapped–ion Cell Using Compensation Electrodes for Fourier Transform Ion Cyclotron Resonance Mass Spectrometry." Int. J. Mass Spectrom. Ion Proc. 151, 175(1995).

P. Caravatti and M. Allemann, "The "Infinity Cell": a New Trapped–Ion Cell With Radiofrequency Covered Trapping Electrodes for Fourier Transform Ion Cyclotron Resonance Mass Spectrometry", Org. Mass Spectrom. 26, 514(1991).

T. Hayashi and N. Sakudo, "Quadrupole Mass Spectrometer Using Circular Concave Electrodes", Proc. Int. Conf. Mass Spectrom., Hyoto, Japan, p. 263 (1969).

R.D. Knight, "Storage of Ions from Laser–Produced Plasmas", Appl. Phys. Lett. 38(4), 221(1981).

A. Makarov, "The Orbitrap: a novel high–performance electrostatic trap", Proceedings of the 47th ASMS Conference on Mass Spectrometry and Allied Topics, 2828(1999).

M.W. Senko et al., "Fourier Transform Mass Spectrometry in a Linear Quadrupole Ion Trap", Proceedings of the 48th ASMS Conference on Mass Spectrometry and Allied Topics, Jun. 11–15, 2000.

METHOD AND APPARATUS FOR FOURIER TRANSFORM MASS SPECTROMETRY (FTMS) IN A LINEAR MULTIPOLE ION TRAP

TECHNICAL FIELD OF THE INVENTION

The present invention relates generally to means and method for a linear, multipole ion trap whereby ions from an ion source are transmitted through a differential pump system and into a multipole trap device for trapping and analysis. More specifically, an apparatus for a linear quadrupole trap is described which uses one multipole device comprising two trapping regions and one analyzing section to provide an improved mass analyzer.

BACKGROUND OF THE PRESENT INVENTION

The present invention relates generally to a multipole ion trap for use in mass spectrometry. The methods for transferring, trapping and analyzing ions described herein are enhancements of the techniques referred to in the literature relating to mass spectrometry.

Mass spectrometry is an important tool in the analysis of a wide range of chemical compounds. Specifically, mass spectrometers can be used to determine the molecular weight of sample compounds. The analysis of samples by mass spectrometry consists of three main steps—formation of gas phase ions from sample material, mass analysis of the ions to separate the ions from one another according to ion mass, and detection of the ions. A variety of means exist in the field of mass spectrometry to perform each of these three functions. The particular combination of means used in a given spectrometer determine the characteristics of that spectrometer.

To mass analyze ions, for example, one might use a magnetic (B) or electrostatic (E) analyzer. Ions passing through a magnetic or electrostatic field will follow a curved path. In a magnetic field the curvature of the path will be indicative of the momentum-to-charge ratio of the ion. In an electrostatic field, the curvature of the path will be indicative of the energy-to-charge ratio of the ion. If magnetic and electrostatic analyzers are used consecutively, then both the momentum-to-charge and energy-to-charge ratios of the ions will be known and the mass of the ion will thereby be determined. Other mass analyzers are the quadrupole (Q), the ion cyclotron resonance (ICR), the time-of-flight (TOF), and the quadrupole ion trap analyzers.

Before mass analysis can begin, however, gas phase ions must be formed from sample material. If the sample material is sufficiently volatile, ions may be formed by electron impact (EI) or chemical ionization (CI) of the gas phase sample molecules. For solid samples (e.g. semiconductors, or crystallized materials), ions can be formed by desorption and ionization of sample molecules by bombardment with high energy particles. Secondary ion mass spectrometry (SIMS), for example, uses keV ions to desorb and ionize sample material. In the SIMS process a large amount of energy is deposited in the analyte molecules. As a result, fragile molecules will be fragmented. This fragmentation is undesirable in that information regarding the original composition of the sample—e.g., the molecular weight of sample molecules—will be lost.

For more labile, fragile molecules, other ionization methods now exist. The plasma desorption (PD) technique was introduced by Macfarlane et al. in 1974 (Macfarlane, R. D.; Skowronski, R. P.; Torgerson, D. F., *Biochem. Biophys. Res Commoun.* 60 (1974) 616). Macfarlane et al. discovered that the impact of high energy (MeV) ions on a surface, like SIMS would cause desorption and ionization of small analyte molecules, however, unlike SIMS, the PD process results also in the desorption of larger, more labile species—e.g., insulin and other protein molecules.

Lasers have been used in a similar manner to induce desorption of biological or other labile molecules. See, for example, VanBreeman, R. B.: Snow, M.: Cotter, R. J., *Int. J. Mass Spectrom. Ion Phys.* 49 (1983) 35; Tabet, J. C.; Cotter, R. J., *Anal. Chem.* 56 (1984) 1662; or Olthoff, J. K.; Lys, I.: Demirev, P.: Cotter, R. J., *Anal. Instrument.* 16 (1987) 93. Cotter et al. modified a CVC 2000 time-of-flight mass spectrometer for infrared laser desorption of involatile biomolecules, using a Tachisto (Needham, Mass.) model 215G pulsed carbon dioxide laser. The plasma or laser desorption and ionization of labile molecules relies on the deposition of little or no energy in the analyte molecules of interest. The use of lasers to desorb and ionize labile molecules intact was enhanced by the introduction of matrix assisted laser desorption ionization (MALDI) (Tanaka, K.; Waki, H.; Ido, Y.; Akita, S.; Yoshida, Y.; Yoshica, T., *Rapid Commun. Mass Spectrom.* 2 (1988) 151 and Karas, M.; Hillenkamp, F., *Anal. Chem.* 60 (1988) 2299). In the MALDI process, an analyte is dissolved in a solid, organic matrix. Laser light of a wavelength that is absorbed by the solid matrix but not by the analyte is used to excite the sample. Thus, the matrix is excited directly by the laser, and the excited matrix sublimes into the gas phase carrying with it the analyte molecules. The analyte molecules are then ionized by proton, electron, or cation transfer from the matrix molecules to the analyte molecules. This process, MALDI, is typically used in conjunction with time-of-flight mass spectrometry (TOFMS) and can be used to measure the molecular weights of proteins in excess of 100,000 daltons.

Atmospheric pressure ionization (API) includes a number of methods. Typically, analyte ions are produced from liquid solution at atmospheric pressure. One of the more widely used methods, known as electrospray ionization (ESI), was first suggested by Dole et al. (M. Dole, L. L. Mack, R. L. Hines, R. C. Mobley, L. D. Ferguson, M. B. Alice, *J. Chem. Phys.* 49, 2240, 1968). In the electrospray technique, analyte is dissolved in a liquid solution and sprayed from a needle. The spray is induced by the application of a potential difference between the needle and a counter electrode. The spray results in the formation of fine, charged droplets of solution containing analyte molecules. In the gas phase, the solvent evaporates leaving behind charged, gas phase, analyte ions. Very large ions can be formed in this way. Ions as large as 1 MDa have been detected by ESI in conjunction with mass spectrometry (ESMS).

ESMS was introduced by Yamashita and Fenn (M. Yamashita and J. B. Fenn, *J. Phys. Chem.* 88, 4671, 1984). To establish this combination of ESI and MS, ions had to be formed at atmospheric pressure, and then introduced into the vacuum system of a mass analyzer via a differentially pumped interface. The combination of ESI and MS afforded scientists the opportunity to mass analyze a wide range of samples. ESMS is now widely used primarily in the analysis of biomolecules (e.g. proteins) and complex organic molecules.

In the intervening years a number of means and methods useful to ESMS and API-MS have been developed. Specifically, much work has focused on sprayers and ionization chambers. In addition to the original electrospray technique, pneumatic assisted electrospray, dual electrospray, and nano electrospray are now also widely available. Pneumatic assisted electrospray (A. P. Bruins, T. R. Covey, and J. D. Henion, Anal. Chem. 59, 2642, 1987) uses nebulizing gas flowing past the tip of the spray needle to assist in the formation of droplets. The nebulization gas assists in the formation of the spray and thereby makes the operation of the ESI easier. Nano electrospray (M. S. Wilm, M. Mann, *Int. J. Mass Spectrom. Ion Processes* 136, 167, 1994) employs a much smaller diameter needle than the original electrospray. As a result the flow rate of sample to the tip is lower and the droplets in the spray are finer. However, the ion signal provided by nano electrospray in conjunction with MS is essentially the same as with the original electrospray. Nano electrospray is therefore much more sensitive with respect to the amount of material necessary to perform a given analysis.

In the field of Fourier Transform ion cyclotron Resonance Mass Spectrometry ("FTICR-MS") a Penning ion Trap is used to trap ions. The conventional Penning trap consists of six metal plates forming a cube in a magnetic field (M. B. Comisarow, *Adv. Mass Spectrom.* 8, 1698(1980), M. B. Comisarow, *Int. J. Mass Spectrom. Ion Phys.* 37, 251 (1981)). Two of these plates ("trapping plates") reside in planes perpendicular to the magnetic field whereas the other four plates are in planes parallel to the magnetic field. In conventional FTICR-MS, the trapping plates together with the magnetic field are used to trap ions. This is accomplished by applying a small electrical potential (e.g. 1V) to the trapping plates. The remaining plates are held at ground potential. The magnetic field confines ions in the plane perpendicular to the magnetic field line, and the electric field produced by the potential difference between the trap electrodes confines the ions along the magnetic field lines.

Ions in a uniform magnetic field, barring other influences, move in circular orbits (cyclotron motion) with a frequency proportional to ion mass-to-charge ratio (A. G. Marshall, L. H. Christopher, G. S. Jackson, *Mass Spectrom. Rev.*, in press, 1998). However, the presence of an electrostatic field, such as that produced by the trapping plates, produces new modes of motion (magnetron, and trapping) and alters the frequency of the cyclotron motion of the ions. This reduces the resolution of the spectrometer and causes a distortion in the relationship between ion m/z and cyclotron frequency.

The magnitude of the potentials placed on the trapping electrodes is significant both to the degree to which the cyclotron motion is distorted and to the range of the kinetic energy that an ion can have along the magnetic field lines and still be trapped. The kinetic energy of the ions which can be trapped is directly related to the potential on the trapping electrodes and so is the distortion on the cyclotron motion. Thus, in a prior art FTICR cell, the potential on the trapping electrodes would be set as a compromise between trapable ion kinetic energy and distortion in cyclotron motion. The trapping potential must be kept low (e.g. 1V) to avoid excessive cyclotron motion, and as a result, the range of trapable ion kinetic energies is also low (e.g. 1 eV). This limits the FTMS method in its application to external ion sources because such sources often produce ion beams which have a broad range of kinetic energies (R. C. Beavis, B. T. Chait, *Chem. Phy. Lett.* 181, 479(1991), T.-W. D. Chan et al., *Chem. Phy. Lett.* 222, 579(1994), J. A. Castoro, C. Koester, C. L. Wilkins, *Rapid Commun. Mass Spectrom.* 6, 239(1992), C. Koester, J. A. Castoro, C. L. Wilkins, *J. Am. Chem. Soc.* 114, 7572(1992), J. Yao, M. Dey, S. J. Pastor, C. L. Wilkins, *Anal. Chem.* 67, 3638(1995), T. Solouki, D. H. Russel, *Proc. Natl. Acad. Sci. USA* 89, 5701(1992), T. Solouki, K. J. Gilling, D. H. Russel, *Anal. Chem.* 66, 1583(1994)).

In Laude et al. ("Laude"), cylindrical compensation electrodes were inserted between the trap electrodes and the excite/detect electrodes (V. H. Vartanian, F. Hadjarab, D. A. laude, *Int. J. Mass Spectrom. Ion Proc.* 151, 157(1995)). A reduction in the cyclotron frequency shift of more than 99% was observed.

In the related field of quadrupole mass spectrometry, ions are analyzed via an oscillating electric field ("Quadrupole Mass Spectrometry and its Applications", Peter Dawson, ed., copyright 1976, Elsevier Publishing Company, Amsterdam). Typically a quadrupolar electric field is established between four electrodes in the case of a linear quadrupole. Ions are injected into one end of the linear quadrupole and under the influence of the electric field, either pass through to the exit end of the quadrupole or are caused to collide with the electrodes of the quadrupole. By applying the appropriate static and oscillating potentials between the electrodes of the quadrupole, one can select ions of a prespecified mass-to-charge ratio (m/z) to pass from the entrance of the quadrupole to its exit while largely excluding all other m/z ions. Thus, the device acts as a quadrupole mass filter.

The electrodes of a quadrupole mass filter might be designed in many ways. Ideally, four electrodes each having a hyperbolic surface can be used. In theory, electrodes of this form could be used to produce a perfectly quadrupolar electric field. In practice, electrodes of cylindrical geometry are typically used. That is, four cylindrical, rod shaped electrodes are placed symmetrically about the axis of the quadrupole mass filter. This arrangement of electrodes is easier to produce than the hyperbolic electrodes and can be used to produce a close approximation of a quadrupolar electric field.

Alternatively, researchers such as T. Hayashi and N. Sakudo (T. Hayashi and N. Sakudo, Proc. Int. Conf. Mass Spectrom., Hyoto, Japan, 1969 ("Hayashi and Sakudo")), and more recently J. Prestage (John D. Prestage, *NASA Technical Brief* 23(5), pp. 168(May 1999) ("Prestage")) have employed arch shaped electrodes to produce quadrupole mass filters. Such electrode arrangements might also be used to produce close approximations of quadrupolar electric fields. More than four electrodes may be used in such designs. A larger number of electrodes allows for a closer approximation of a quadrupolar field. For example, by employing eight electrodes, Prestage can approximate the quadrupolar field to sixth order. Advantages of this method of producing a quadrupole mass filter include relatively easy production, light weight construction, and less power consumed during operation.

For Example, FIG. 1 depicts the multipole ion guide of Prestage. Shown is multipole ion guide 6 comprising eight electrodes 2 & 4 are arranged symmetrically around a central axis. Four electrodes 2 are grounded, while an oscillating potential of +/− V is applied between the remaining four electrodes 4. The multipole is extended along its axis and cylindrical in shape with two openings for ions to enter 8 and exit 10 the guide 6. When used as a quadrupole mass filter, the ions enter the guide, and selected ions pass through the device to the exit end 10. To be mass selective, a DC potential is applied between the V+ electrodes and the V− electrodes. If no DC potential is applied, the device will simply transfer ions from the entrance 8 to the exit end 10 of the device.

An alternate embodiment of the multipole 6 of Prestage is depicted in FIG. 2. In addition to the multipole of FIG. 1, there are two cylindrically symmetric apertured plates 12 &

14. The apertured plates 12 & 14 are disposed on opposite ends of the multipole. The first apertured plate 14, labeled the "Entrance Electrode" is between the ion source(not shown) the entrance 8. The second apertured plate 12 is disposed downstream the first plate 14 and it is labeled the "Exit Electrode". By applying a DC offset between these electrodes and the multipole, ions can be trapped in the multipole. Ions would be contained radially by the RF potential applied between the +/− V electrodes and axially by the potential applied to the entrance and exit electrodes.

A second form of quadrupole mass analyzer is referred to as a quadrupole ion trap (or Paul trap). In contrast to the Penning trap of FTICR MS, the Paul trap does not require and does not use a magnetic field to trap ions. Rather, only an oscillating electric field is used to trap the ions. The Paul trap is a cylindrically symmetric trap composed of three electrodes—a central "ring" electrode and two "cap" electrodes. The two cap electrodes are typically held at the same electrical potential. An oscillating electric field is applied between the cap electrodes and the ring electrode to form a three dimensional quadrupolar field in the interior of the device. Ions can be trapped and manipulated in a variety of ways in this electric field.

Within a quadrupolar electric field, either in a linear device or a three dimensional trap, ions will oscillate with a frequency of motion dependent only on the m/z of the ion. In prior art quadrupole mass analyzers, this characteristic frequency has been used to select, excite, and eject ions from the quadrupole device. In contrast to FTICR MS, ions are detected via a "channeltron"—or other similar—detector rather than by inductive detection. The ions collide with the detector, and are destroyed in the detection process. The inductive detection of FTICR MS preserves the ions because the ions do not collide with the detection device during the detection process.

A third type of related mass analyzer utilizes the Kingdon trap (R. D. Knight, *Appl. Phys. Lett.* 38(4), 221 (1981)). As suggested by R. D. Knight and later by A. Makarov, the Kingdon trap can be used to trap ions and analyze ions in a one dimensional quadratic electrostatic field. In this case, a central electrode and two "outer" electrodes are used to generate a cylindrically symmetric electrostatic field of the form:

$$F=A(Z^2-r^2/2+B\ln r)$$

Where F is the electric potential, r is the distance from the axis of the trap, z is the position along the axis of the device, and A and B are constants. Clearly from this equation, the field along the axis of the trap is quadratic. Thus, ions will oscillate along this axis with a periodic frequency directly related to the mass-to-charge ratio of the ion. The two outer electrodes are placed opposite one another along the axis of the trap such that the ions oscillate between them with the above mentioned periodic motion. As in the FTICR, ions can be detected via their induced charge on the outer electrodes (A. Makarov, Proceedings of the $47^{th}$ ASMS Conference on Mass Spectrometry and Allied Topics, 2828(1999)).

Yet another quadrupole ion trap has been disclosed by Micheal W. Senko, Jae C. Schwartz, Alan E. Schoen and John E. P. Syka, Proceedings of the $48^{th}$ ASMS Conference on Mass Spectrometry and Allied Topics, Jun. 11–15, 2000. Senko et al. disclose a linear quadrupole ion trap comprising a symmetrical arrangement of four detection electrodes and four RF trapping electrodes equally spaced apart around a central longitudinal axis. In the design of Senko et al., each detection electrode is positioned between two RF trapping electrodes, and each RF trapping electrode is positioned between two detection electrodes. Importantly, the electrodes (both detection and trapping) in the Senko et al. design are spaced apart from each other. Such design results in undesirable feedback due to capacitive mismatches as well as RF imbalances.

According to Senko et al., having a truly symmetrically designed quadrupole ion trap will eliminate all feedback detected by the detector from the RF trapping field. This, of course, would require the system be constructed such that it is capacitively matched and that the system be perfectly RF balanced. However, the Senko et al. design is not perfectly RF balanced nor is it capacitively matched. One way Senko et al. attempt to overcome this is by employing high voltage capacitors between each detection and trapping electrode of the system. This too fails to eliminate all of the feedback.

Each of the prior art trapping mass analyzers described above has certain advantages and disadvantages. First, for example, advantages of the FTICR mass spectrometer include high resolution, and mass accuracy, the ability to select ions and perform tandem mass spectrometry (i.e. the selection of ions based on m/z, the fragmentation of the selected ions, and the mass analysis of the fragment ions) on those ions, to detect ions non-destructively, and to detect ions simultaneously across a wide m/z range. Conversely, disadvantages of FTICR include the required use of a strong, highly homogeneous magnetic field, a limited mass range, and limited speed of mass analysis. Second, advantages of the quadrupole mass filter include relative ease of production and use, sensitivity, and quantitation while, disadvantages of the quadrupole mass filter include limited mass range, speed of mass analysis, mass accuracy, and mass resolution. Third, advantages of the alternate design quadrupole mass filters (e.g. as given by Prestage) are potentially further simplified production, lighter weight, and lower power consumed. While disadvantages are lower resolution, mass accuracy, general performance (i.e. the field produced in such a device is not truly quadratic). Fourth advantages of the quadrupole ion trap are the ability to trap and select ions to perform tandem mass spectrometry experiments on the trapped ions, moderate resolution, and moderate mass accuracy. Disadvantages of the quadrupole ion trap are the dependence of mass resolution on scan speed, poor duty cycle (i.e. most ions are lost rather than analyzed, poor trapping capacity) only a small number of ions can be trapped without perturbing the mass analysis. Fifth, advantages of the Kingdon trap are the ability to trap and analyze ions without the need for a magnetic field (as in FTICR) and without the need for an oscillating electrical potential (as used with quadrupole mass filters and quadrupole traps), the ability to detect ions non-destructively, moderate mass resolving power, and potentially the ability to perform tandem mass spectrometry experiments. On the other hand, disadvantages of the Kingdon trap are difficulty of forming and aligning the trap electrodes, complexity of ion introduction into the trap (i.e. ions are trapped only so long as they have a stable orbit about the central electrode) difficulty to excite ions into a coherent axial motion. Yet another disadvantage of the prior art designs includes the existence of undesirable feedback.

The present invention distinguishes itself from prior art by providing a means and method for a novel type of mass analyzer having a unique set of advantages over the above mentioned mass analyzers.

SUMMARY OF THE INVENTION

The present invention provides a means and method for a new type of mass analyzer capable of filtering and trapping ions with specific advantages over prior art mass analyzers.

In the prior art multipole design according to Prestage (FIGS. 1 and 2), eight electrodes are arranged symmetrically around a central axis. Four of these are grounded and an oscillating potential of +/− V is applied between the other four electrodes. According to Prestage, the multipole is extended along its axis such that it is substantially cylindrical in shape. Being cylindrical, the device has two openings, —one at each end—and the device can be used as a quadrupole mass filter. In this case, ions enter one end of the multipole and only selected ions pass completely through the multipole to its exit end. If the multipole is to be mass selective, then a DC potential must be applied between the V+ electrodes and the V− electrodes. Alternatively, if no DC potential is applied, the multipole may be used as an ion guide (i.e., simply to transfer ions from the entrance end to the exit end of the device).

According to the present invention, the electrodes which were grounded according to Prestage are held only nominally at 0 volts. For example, these electrodes are each independently connected to ground through a 1 megaohm (Mohm) resistor. These nominally grounded electrodes are then used to detect trapped ions via charge induction in the manner of Fourier Transform Ion Cyclotron Resonance (FTICR) Mass Spectrometer. More particularly, ions are first cooled to the center of the trap via collisions with the rest gas. During subsequent ion excitation and detection, the trap is substantially free of gas. The ions are then excited by applying a broadband excitation pulse between the V+ and V− electrodes. This broadband excitation pulse is applied so as to induce the ions to orbit about the axis of the ion trap in coherent ion packets. While ions might be distributed along the length of the trap, substantially all ions of a given m/z should be at about the same angular position in their orbits at the same time. Further, ions of a given m/z will have a given frequency of motion about the central axis of the trap. As in conventional FTICR, by measuring the frequency of the signal induced on the detection electrodes, the m/z of the ions can be determined, and by measuring the amplitude of the induced signal, the relative number of ions of that given m/z can be determined.

In an alternate embodiment of the linear multipole trap according to the present invention, a central set of electrodes and two trapping electrodes (instead of the DC trap electrodes) may be used. The trapping multipoles are held at a slightly higher DC potential than the central analysis multipole (e.g., 2V). This DC offset between the multipoles serves to trap ions in the analysis multipole (i.e., the central electrodes). At the ends of the analysis multipole, the oscillating quadrupolar field is not greatly perturbed and therefore the motion of the ions at the center of the multipole is therefore substantially the same as the motion of ions near the ends of the analysis multipole. The RF electrodes of the trapping multipoles and analysis multipoles are all driven by the same RF driver. Therefore, the RF electrodes will all have the same potentials and frequencies applied to them, and the RF electrodes of the analyzing multipole are capacitively coupled to their counterparts in the trapping multipoles.

Yet another embodiment of the linear multipole trap according to the invention may comprise only a single multipole with the detection electrodes divided into three sections to achieve the same effect. That is, the central section is the "analyzing" section, whereas the two outer sections are the "trapping" sections. The regions of the detection electrodes defining the trapping section of the multipole are not used to detect ions —rather, these electrodes are held at a high DC potential with respect to the central detection electrodes, which tends to repel the ions back into the analyzing section. The combination of this DC field and the RF field generated by the potential applied between the RF electrodes, traps ions within the analyzing section of the multipole. The advantage of this embodiment is that, without regard to mechanical tolerances, the RF field is guaranteed to be homogeneous throughout the multipole (i.e., there is no RF electric field component along the axis of multipole and the RF field experienced by an ion is not dependent on its position along the axis of the multipole).

In a mass spectrometer employing the preferred embodiment of the linear multipole trap according to the present invention, ions may be generated at an elevated pressure (e.g., atmospheric pressure) via, for example, electrospray ionization. Ions are transferred, by entrainment in a gas flow, through a capillary from the atmospheric pressure region into a first pumping region. Some of these ions pass through the first pumping region and into a second pumping region through a skimmer. In the second pumping region, ions enter a first trapping section of the multipole. The pressure in the second pumping region is such that ions undergo sufficient collisions with the gas in the first trapping section of the linear multipole trap to be cooled to near room temperature (e.g., $10^{-2}$ mbar). Having been cooled to near room temperature, the ions are allowed to pass into the analysis section. This third pumping region is pumped to a lower pressure than the second pumping region, such that the ions have a large mean free path.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF A PREFERRED EMBODIMENT

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention. The following presents a detailed description of a preferred embodiment (as well as some alternative embodiments) of the present invention.

Figure 1:
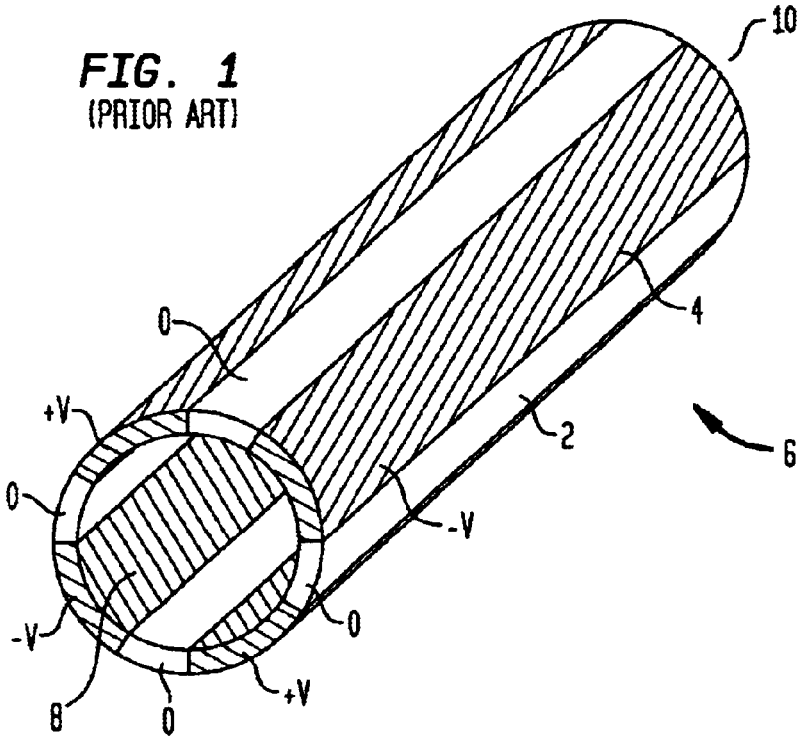
FIG. 1 (PRIOR ART)
FIG. 1 shows a prior art multipole design according to J. D. Prestage with eight electrodes arranged symmetrically around a central axis.
Figure 2:
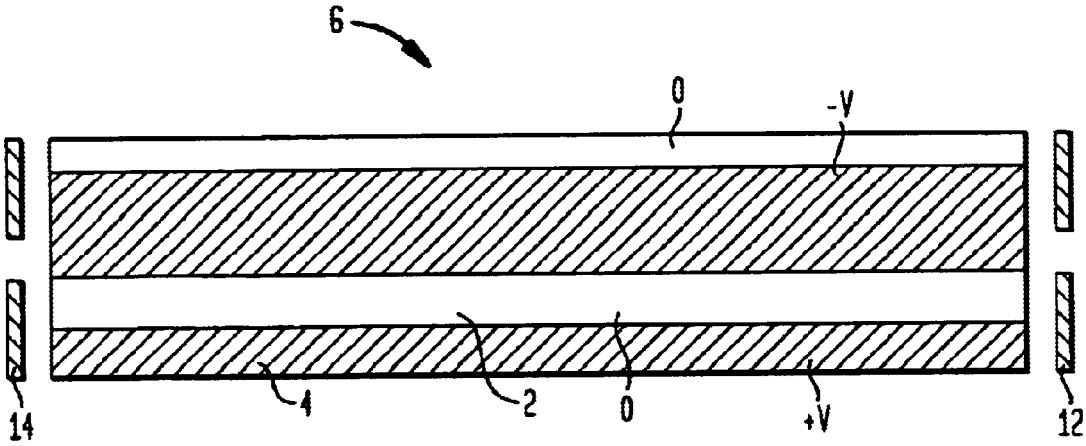
FIG. 2 (PRIOR ART)
FIG. 2 shows the prior art multipole design of FIG. 1 further comprising cylindrically symmetric aperatured plates at either end thereof.
Figure 3:
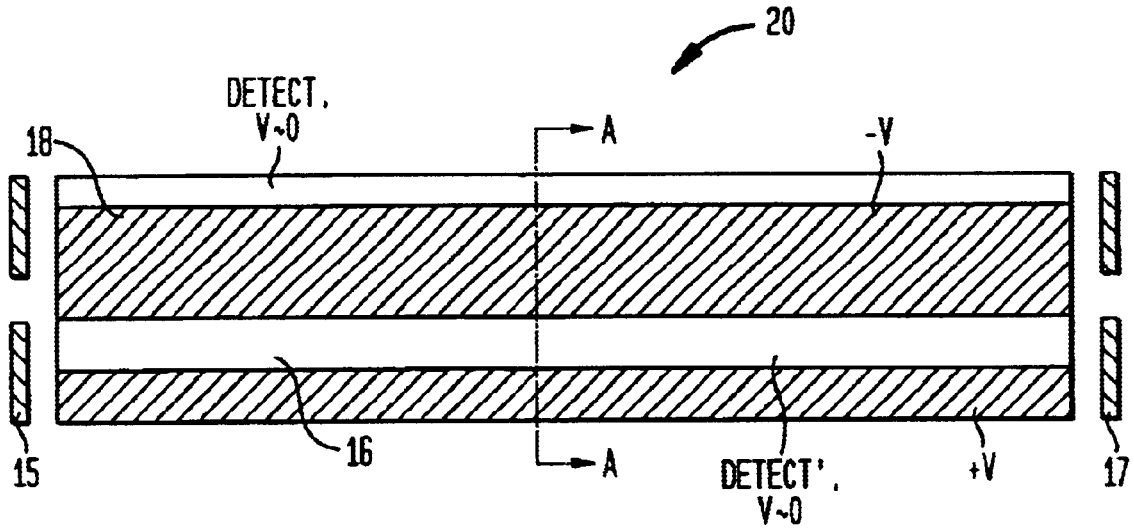
FIG. 3 shows the preferred embodiment of the linear quadrupole trap according to the present invention having DC trap electrodes.
Figure 3A:
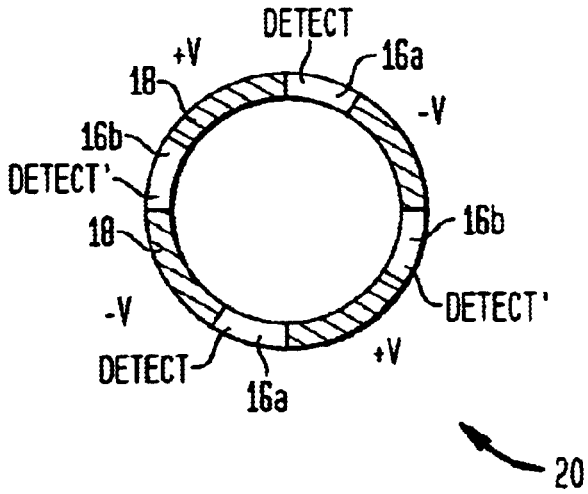

Referring first to FIG. 3, depicted is a multipole ion guide, similar to the Prestage device of FIG. 2, with the grounded electrodes 16 only nominally held at zero volts. In contrast, each electrode 16 of multipole device 20 is connected to ground (e.g, independently through a 1 Mohm resistor). Electrodes 16 & 18 detect trapped ions by charge induction in the manner of FTICR mass spectrometry. The ions are first cooled to the center-line of the trap 20 by collisions with a rest gas at a pressure in the range of about $10^{-2}$ to $10^{-3}$ mbar. Next, the gas is pumped away such that the ion trap 20 is operated in a vacuum at a pressure in the range of about $10^{-7}$ to $10^{-10}$ mbar. The +/− V electrodes 18 generates a broadband excitation pulse and gives the ions a velocity in a direction perpendicular to the axis of the trap 20. The ions then orbit the axis of the ion trap 20 in coherent ion packets with ions of a given m/z at about the same angular position in their orbits at the same time. The frequency of the motion of ions of a given m/z about the axis of the trap 20 can be measured by the signal induced on the detection electrodes. Also, the four nominally grounded electrodes 16 are divided into two "Detect" 16*a* electrodes that are electrically connected, and two "Detect'" 16*b* electrodes that are also electrically connected, respectively. The Detect 16*a* electrodes and the Detect' 16*b* electrodes are connected to two respective inputs of a differential amplifier. As a result, for every orbit of the ions, two cycles are detected in the induced signal.

Figure 4:
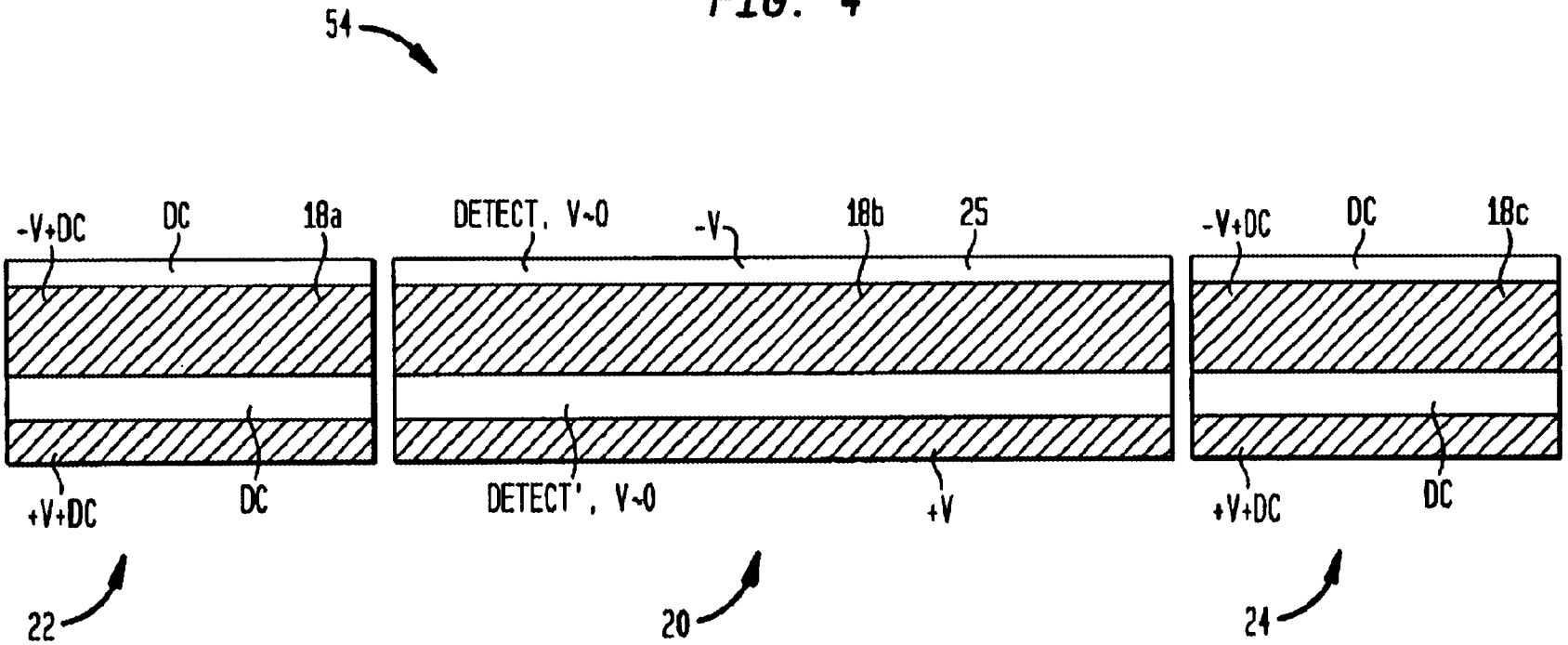
FIG. 4 shows an alternate embodiment of the linear quadrupole trap according to the present invention, having a central set of electrodes.

Referring next to FIG. 4, depicted is the multipole 20 of FIG. 3 as it is incorporated between two trapping multipoles 22 & 24. The trapping multipoles 22 & 24 are held at a higher DC potential than the central multipole 20. This arrangement allows for a more homogeneous quadrupolar field within the analysis multipole 20 and the ions at the center and at the ends of the multipole 20 will have the same motion. All of the RF electrodes 18*a*, 18*b* & 18*c* of the trapping multipoles and the analyzing multipoles will have the same potentials and frequencies. Therefore, RF electrodes 18*a* are capacitively coupled to 18*b* and 18*c*.

Figure 5:
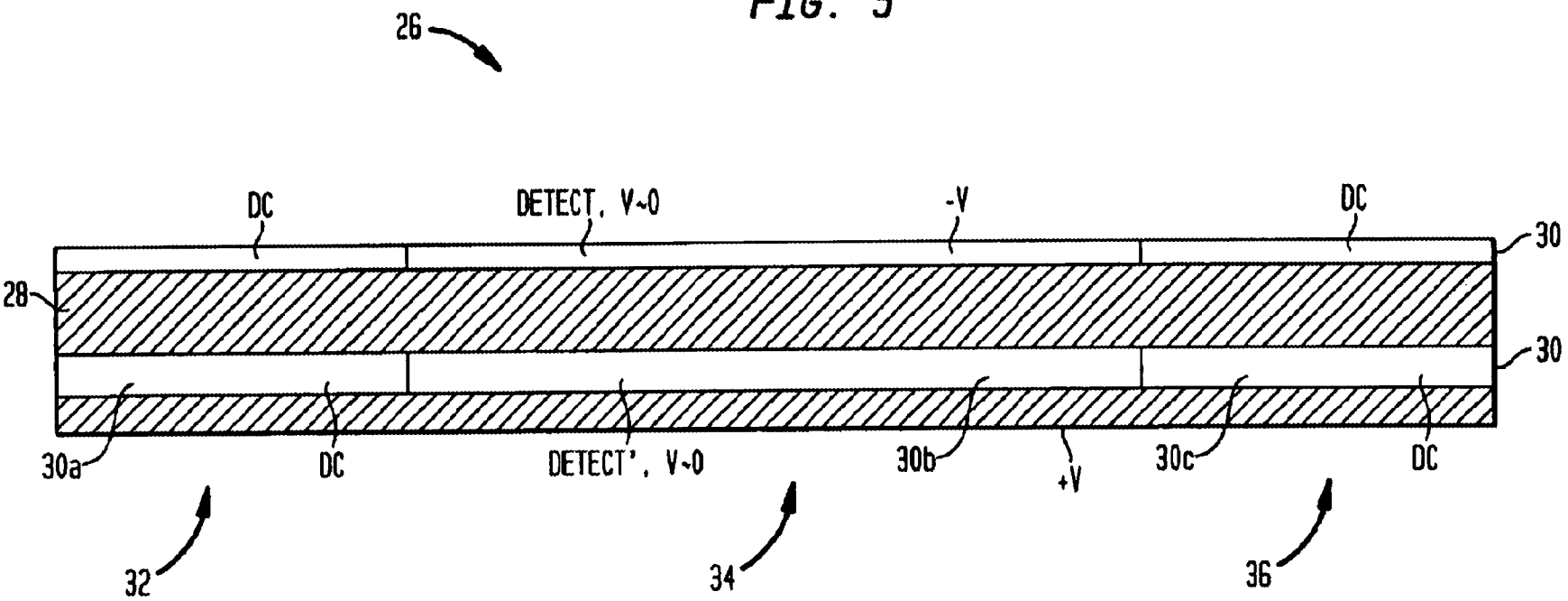
FIG. 5 shows another alternate embodiment of the linear quadrupole trap according to the present invention, comprising a single multipole having a single set of RF electrodes.

Turning now to FIG. 5, depicted is a single multipole 26 with a single set of RF electrodes 28, and detection electrodes 30 divided into three sections. The divisions made by the detection electrodes 30 define the trapping sections 32 & 36, and the analyzing section 34. The detection electrodes 30 in the trapping sections 32 & 36 are held at a DC potential (e.g., in the range from 0.1 volts to 100 volts) with respect to the central detection electrodes 30 to trap ions in the central analyzing region 34. The detection electrodes 30*a* & 30*c* in the two trapping regions 32 &34 are not used for detection. Instead, these electrodes 30*a* & 30*c* are held at a DC potential with respect to the central detection electrodes 30*b*. In this embodiment, the RF field generated by the RF electrodes 28 may be substantially homogeneous within the multipole.

Figure 6:
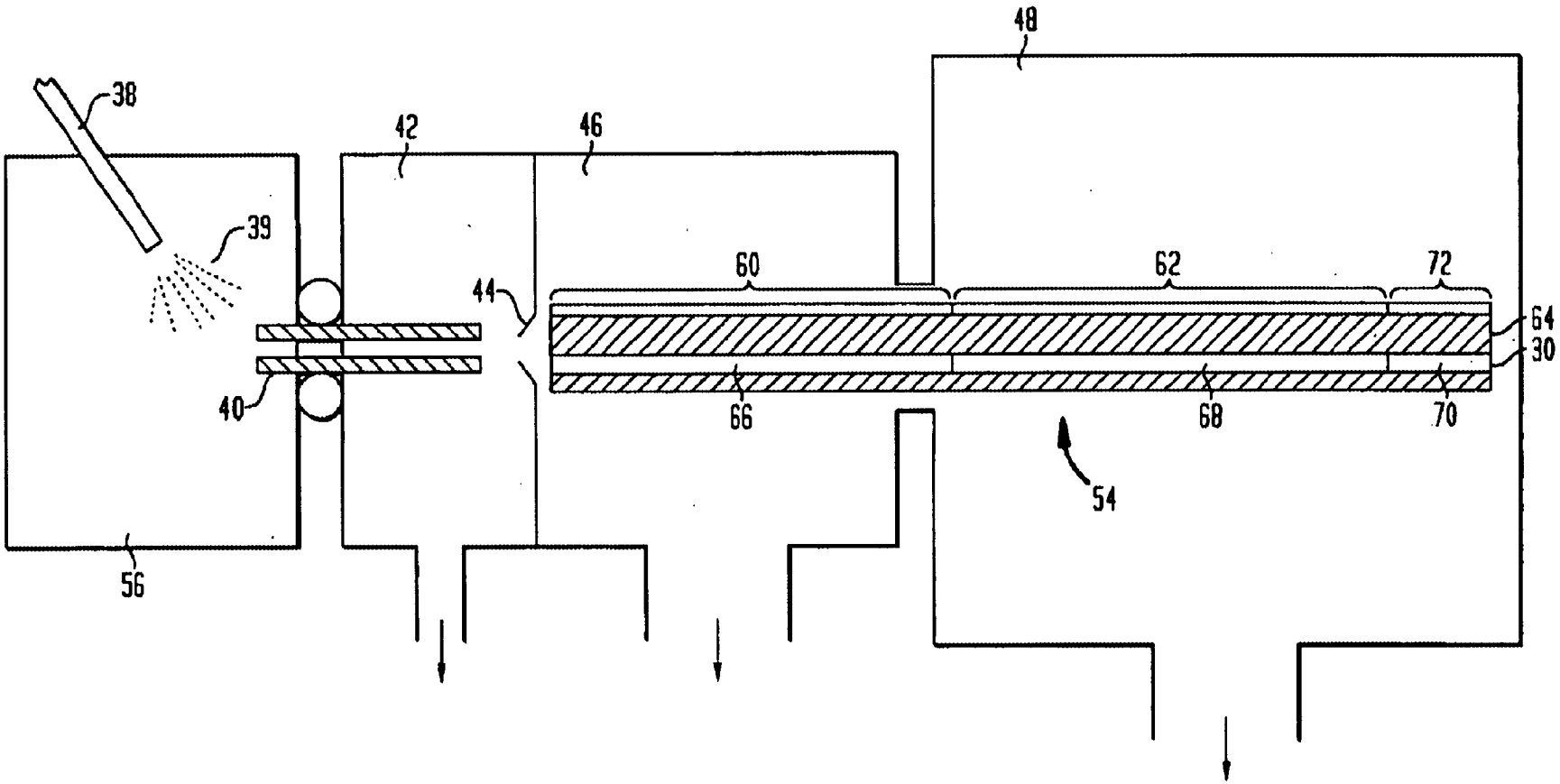
FIG. 6 shows the linear quadrupole trap of FIG. 5 as it may be implemented into a mass spectrometer for performing tandem mass spectrometry analysis.

Finally, referring to FIG. 6, depicted is a mass spectrometer employing the preferred embodiment of the linear multipole trap of FIG. 5 using an atmospheric pressure ion source 38. The ions are transferred by gas flow through a capillary 40 into a first differential pumping region 42 from an elevated pressure source 56. Some ions then pass into a second differential pumping region through a skimmer 44. The ions then enter the first trapping multipole 60 of the multipole device 54. The pressure of the second pumping region 46 allows the gas of the first rapping section 60 to cool the ions to near room temperature. Ions are then allowed to enter the central analyzing region 62 of the multipole 54 within a third pumping region 54. Before reaching the analysis section, the ions move into yet a third pumping region, which is separated from the second pumping region by a pumping restriction. The third pumping region 48 is at a lower pressure than the second pumping region 56 to produce a higher resolution mass spectrum. This is important for producing long transients during ion detection and therefore a higher resolution mass spectrum. Once the ions are in the analysis section, a DC potential is applied to the DC electrodes of the first trapping section such that ions become trapped in the analysis section of the linear multipole trap through the combination of the RF and DC fields between the electrodes. Optionally, the trapping potential on the DC electrodes of the second trapping section may be kept on continuously.

In the analysis region 62, a DC potential is applied to the DC electrodes 68 of the first trapping section 60 to stop the ions from escaping the analysis region 62. Again, ions are excited into periodic motion by an electrical pulse applied between either the RF 64 or DC electrodes 66, 68 & 770. After the excitation pulse is turned off, the ions are detected b y charge induction on the detection electrodes 72. Using the apparatus of FIG. 6, tandem mass spectrometry experiments may be formed.

During analysis, ions are excited into periodic motion by an electrical pulse applied between either the RF or DC electrodes. After ion excitation, the excitation pulse is turned off and the ions are detected by charge induction on the detection electrodes. As excited ions orbit—in a substantially circular orbit—around the axis of the multipole, they approach each detection electrode in succession as a function of the ion's and electrodes' angular position. As discussed above, the detection electrodes are connected to a differential amplifier such that the potential on the detect electrode (i.e., the electrode nearest the ion being detected) is measured with respect to the potential on the detect' electrodes. This results in a substantially sinusoidal signal having a frequency corresponding to twice the orbital frequency of the ions and an amplitude proportional to the number of ions in the linear multipole trap.

Alternatively, the ions might be excited into a strongly oval orbit, approaching a periodic motion along a single axis of the multipole. In this case, the two detect electrodes are not electrically connected to one another (as suggested above), nor are the two detect' electrodes electrically connected to one another (also as suggested above). The ions are excited into motion by applying an electrical pulse between, for example, the two detect' electrodes. The ions then will move back and forth substantially between these two detect' electrodes with little or no motion along the axis connecting the two detect electrodes. Once the ions are excited, the detect' electrodes are electronically switched from excite mode to detect mode. In detect mode, the ions induce charge on the detect' electrodes. The opposing detect' electrodes are each electrically connected to one input of a differential amplifier. As above, the differential amplifier measures the potential difference between the opposing detect' electrodes. The result is (as described above) a substantially sinusoidal signal, the frequency of which corresponds to the frequency of the motion of ions between the two detect' electrodes and the amplitude of which is proportional to the number of ions in the trap.

Notice that the ions, once excited, will undergo oscillations for some extended period of time. This oscillation period is dependent on the pressure in the analyzer section of the multipole. If the pressure is sufficiently low (e.g. $<10^{-9}$ mbar) the ions may oscillate for seconds. This will result in higher mass resolution and higher sensitivity in the mass spectrum produced.

It may happen that, due to micromotion (or some other cause), the phase of the ions may change during the analysis. Once the ions are sufficiently out of phase with one another, the signal induced on the detection electrodes by the ions will be low or nonexistent. In such a case it may be desirable to cool the ions and reexcite them to perform a new measurement. According to the preferred embodiment of the invention this might be done by either pulsing gas into the analyzer section of the multipole to cool the ions to the center of the multipole, or by bringing the DC electrodes of the first trapping section to a neutral or attractive potential. By doing this, ions from the analyzer section would reenter the first trapping section (where the pressure is higher) and undergo collisional cooling via the gas in the first trapping region. Following this, ions could be reinjected into the analyzer section for repeated mass analysis In a similar manner, one might perform tandem mass spectrometry experiments. In such a case all ions except those having the m/z of the precursor ion of interest are ejected from the analyzer section by, for example resonance ejection. Precursor ions might be accumulated for an extended period of time in the analyzer section so as to achieve a desired ion population. The precursor ions are then injected back into first trapping section via a substantial potential on the DC electrodes of the first trapping section. This potential accelerates the ions to a "high" kinetic energy (e.g. 100 eV) such that when these ions collide with gas molecules in the multipole, they undergo fragmentation. The fragment ions formed in this way as well as the precursor ions are cooled to near room temperature by further collisions with the gas and then reinjected into the analysis section for mass analysis. Note that a new precursor might be selected from the fragment ion population for additional fragmentation and mass analysis. This process might be repeated many times in the performance of so called "$MS^n$" experiments. Note also that after accumulating precursor ions above and before injecting the precursor ions into the first trapping section, it is necessary that additional ions be prevented from entering the multipole from the ion production region. To accomplish this a physical shudder might be used to block the passage of ions from the spray chamber to the multipole or a reverse bias might be applied between the exit of the transfer capillary and skimmer to repel ions from the skimmer so they do not pass the skimmer and get into the multipole.

Any other method used in the field of FTICR MS or quadrupole or quadrupole trap MS—resonant ejection or isolation, IRMPD, SID, CID, SWIFT, BIRD, etc. —might be used in conjunction with the present invention.

While the present invention has been described with reference to one or more preferred embodiments, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. A multipole device for transferring, trapping and analyzing ions in a mass spectrometer, said multipole device comprising:

a plurality of electrodes, said electrodes comprising a plurality of RF electrodes, and at least one first; and second detection electrodes;

at least two trapping electrodes; and a differential amplifier having first and second inputs;

wherein said plurality of electrodes are arranged such that no two RF electrodes are adjacent and no two detection electrodes are adjacent;

wherein all of said first detection electrodes are electrically connected and all of said second detection electrodes are electrically connected;

wherein said first detection electrodes are connected to said first input and said second detection electrodes are connected to said second input;

wherein one of said trapping electrodes is positioned at each end of said plurality of electrodes is positioned at each end of said plurality of electrodes such that when an appropriate DC potential is applied thereto said ions become trapped within said plurality of electrodes; and wherein said differential amplifier measure the potentials on said detection electrodes to determine the m/z ratio of said ions.

2. A multipole device according to claim 1, wherein said plurality of electrodes are arranged in a substantially circular manner.

3. A multipole device according to claim 1, wherein said plurality of electrodes detect trapped ions by charge induction.

4. A multipole device according to claim 1, wherein said plurality of electrodes detect ions in the manner of FTICR mass spectrometry.

5. A multipole device according to claim 1, wherein said apparatus contains four RF electrodes, and four detection electrodes.

6. A multipole device according to claim 1, wherein said device is linear.

7. A multipole device according to claim 1, wherein said RF electrodes of said device have the same potential and frequency as said trapping electrodes.

8. A multipole device according to claim 1, wherein said device is further comprised of a single set of said RF electrodes, and said detection electrodes divide the multipole device into an analyzing section positioned between two trapping sections.

9. A multipole device according to claim 8, wherein said detection electrodes in said trapping sections are held at a DC potential to trap ions in said analyzing section.

10. A linear multipole device for transferring, trapping and anlyzing ions in a mass spectrometer, said multipole device comprising:

four RF electrodes;

four electrodes comprising two first and two second detection electrodes;

two trapping electrodes; and a differential amplifier having first and second inputs;

wherein said electrodes are arranged such that no two RF electrodes are adjacent and no two detection electrodes are adjacent;

wherein both of said first detection electrodes are electrically connected and both of said second detection electrodes are electrically connected;

wherein said first detection electrodes are connected to said first input and said second detection electrodes are connected to said second input;

wherein one of said trapping electrodes is positioned at each end of said electrodes such that when an appropriate DC potential is applied thereto said ions become trapped within said plurality of electrodes; and wherein said differential amplifier measure the potentials on said detection electrodes to determine the m/z ratio of said ions.

11. A linear multipole device according to claim 10, wherein all of said electrodes are circularly arranged.

12. A linear multipole device according to claim 10, wherein said detection electrodes detect trapped ions by charge induction.

13. A linear multipole device according to claim 10, wherein said detection electrodes detect said ions in the manner of FTICR mass spectrometry.

14. A linear multipole device according to claim 10, wherein said RF electrodes have the same potential and frequency as said trapping electrodes.

15. A linear multipole device according to claim 10, wherein said detection electrodes divide said device into three sections comprising one analyzing section located between two trapping sections.

16. A method for analyzing ions in a mass spectrometer, said method comprising the steps of:

directing ions into a multipole device having an analysis region positioned between, and coaxially with, first and second trapping regions;

trapping said ions within said analysis region by creating electric fields across said trapping regions; and analyzing said ions;

wherein said analyzing region includes exciting said ions wherein said analysis region and detecting said ions from within said analysis region.

17. A method according to claim 16, wherein said ions are detected within said analysis region by a plurality of detection electrodes.

18. A method according to claim 17, wherein said plurality of detection electrodes comprises four detection electrodes, allowing detection of said excited, ions in two cycles.

19. A method according to claim 16, wherein said trapping regions are held at a higher DC potwntial than said analysis region to form a substantially homogeneous quadrupolar field within said analyssi region.

20. A method according to claim 16, wherein said exciting is achieved by applying an electrical pulse between electrodes of said analysis region.

21. A method according to claim 20, wherein said exciting causes said ions to move in a substantially circular orbit around a central axis of said analysis region.

22. A method according to claim 20, wherein said exciting causes said ions to move in a substantially oval orbit around a central axis of said analysis region.

23. A method according to claim 16, wherein said ions are detected using charge induction.

24. A method according to claim 16, wherein said ions are detected in the manner of FTICR mass spectrometry.

* * * * *